United States Patent [19]

Coombs

[11] Patent Number: 4,507,806

[45] Date of Patent: Apr. 2, 1985

[54] PROTECTIVE GARMENT

[75] Inventor: Christopher E. Coombs, Boonton Township, Morris County, N.J.

[73] Assignee: Cairns & Brother, Inc., Clifton, N.J.

[21] Appl. No.: 470,462

[22] Filed: Feb. 28, 1983

[51] Int. Cl.[3] ..... A41D 3/02; A41D 1/00

[52] U.S. Cl. ..... 2/85; 2/97

[58] Field of Search ..... 2/85, 97, 93

[56] References Cited

U.S. PATENT DOCUMENTS

| | | | |
|---|---|---|---|
| 1,485,392 | 3/1924 | Halek | 2/85 |
| 3,085,249 | 4/1963 | De Angelis | 2/97 |
| 4,103,361 | 8/1978 | Carmen | 2/97 |
| 4,338,886 | 7/1982 | Bell | 2/97 |

*Primary Examiner*—Doris L. Troutman

*Attorney, Agent, or Firm*—Louis E. Marn

[57] ABSTRACT

A protective garment of firefighters having a damage resistant outer protective shell, an inner liner having a collar and a moisture barrier either as a separate layer or incorporated in the outer protective shell wherein the outer protective shell is secured to the inner liner proximate to the inner liner collar by a fastening means such that the observance of the collar is indicative of the presence of the inner liner and the collar construction serves to provide protection for the fastening means.

10 Claims, 5 Drawing Figures

PROTECTIVE GARMENT

FIELD OF THE INVENTION

The invention relates to a protective garment, and more particularly to a protective garment for fire fighters for protection from the elements and the hazards of fire fighting, said garment having removably secured multiple layers of protective material.

BACKGROUND OF THE INVENTION

Protective gear for fire fighters usually comprise a helmet, heavy protective turnout coat, some form of upper leg protection which produces similar protective characteristics as the coat, boots and gloves. The fire fighter is required to wear such heavy protective equipment to insulate himself from the structural fire with which he is engaged. The environmental conditions which fire fighters encounter in suppressing a fire produce abnormal exposures which can produce an extraordinary number of potentially injuring situations. The fire fighter is exposed to intense heat, smoke, and moisture, and such environmental conditions are compounded by the general character of the ambient weather conditions, e.g. extreme cold or extreme heat. The fire fighters protective outer garment is primarily designed to shed water and to thermally insulate the fire fighter from the extraordinary heat associated with his fire suppression activity as well as protect him from the ambient weather conditions.

The protective garments presently worn by the fire fighter are comprised of an outer shell of extremely tough fabric for protection, a moisture barrier which serves primarily to shed water and an internal thermal liner. Often time, in hot weather, fire fighters remove the thermal insulating liner of the protective coat for comfort when they are not involved in active fire suppression activity and then don the outer shell absent the liner when called to duty. The fire fighter thereupon has no thermal insulation to protect him from the fire environment and because of the design of the protective garment, there is no visual means by which a superior officer can easily discern whether or not the liner is incorporated in the protective garment. Additionally, because of the environment in which the fire fighter must perform and the physical activity which he must perform, enormous amounts of moisture are generated by the fire fighter's body and such moisture gathers within the thermal insulating liner. Consequently, if the fire fighter is required to respond to a subsequent fire with only a short duration between a first response, the fire fighter finds himself wearing an uncomfortably cold and moisture saturated protective garment. The use of an uncomfortably cold and moisture saturated protective garment has a substantial deleterious effect on the fire fighter both physically and psychologically since it enhances an already abnormal environment in fighting the fire and can physically result in illness to the fire fighter. In addition, relevant industry regulations now require that the thermal liner be physically secured to the outer protective shell so as to prevent fire fighters from removing the liner and possibly subjecting themselves to physical harm in the fighting of a fire with no thermal insulation. While this mandate ensures that the fire fighter will have the benefit of the thermal liner insulation, it precipitated the problem of cleaning and drying of the thermal liner.

As a result of such a mandate, the fire fighter's supervisor is ensured that when he responds to an alarm, the firefighter will have a protective garment containing a thermal liner, however, the mandate also ensures that if the fire fighter must respond to several alarms with little duration between responses, he will be responding to all subsequent alarms with a protective garment having a moisture laden thermal liner.

Additionally, it is desirable from the fire fighters point of view to maintain the protective garment in a state of readiness by constant cleaning protocols. The outer shell is designed primarily to shed water and as such, cleaning is usually perfected by a scrub down and hosing. However, it is desirable to thoroughly wash and dry the thermal liner and if the thermal liner is not removably secured to the outer shell it is not capable of being cleaned by conventional means.

Still further, safety considerations dictate that the outer garment provide the necessary protective characteristics from the neck of the garment to its base. As such, the means for securing the thermal liner within the outer protective garment and the means for securing the outer protective garment itself must be designed so that the fastening means is protected and shielded from the outer environmental conditions by the outer shell.

OBJECTS OF THE INVENTION

An object of the present invention is to provide a novel protective garment for fire fighters comprised of removably secured multiple layers.

Another object of the present invention is to provide a novel protective garment for fire fighters comprised of removably secured multiple protective layers, easily and quickly secured together.

Still another object of the present invention is to provide a novel protective garment for fire fighters which visually indicates to supervisory personnel whether the protective garment comprises its multiple protective layers.

A still further object of the present invention is to provide a novel protective garment for fire fighters comprised of secured multiple protective layers readily separable for easy cleaning.

A still further object of the present invention is to provide a novel protective garment for fire fighters wherein the means for securing multiple protective layers is shielded from the outer environment.

SUMMARY OF THE INVENTION

These and other objects of the present invention are achieved by a protective garment having an outer protective shell, an inner thermal liner and a moisture barrier secured to the outer protective shell proximate to the collar of the garment wherein the inner thermal liner is provided with a neck and throat protective collar such that when fully assembled the presence of the neck and throat protective collar serves to visually indicate that the inner thermal liner is in place.

BRIEF DESCRIPTION OF THE DRAWING

A better understanding of the present invention as well as other objects and advantages thereof will become apparent upon consideration of the detailed disclosure thereof, especially when taken with the accompanying drawings wherein.

DETAILED DESCRIPTION OF THE DRAWINGS

Figure 1:
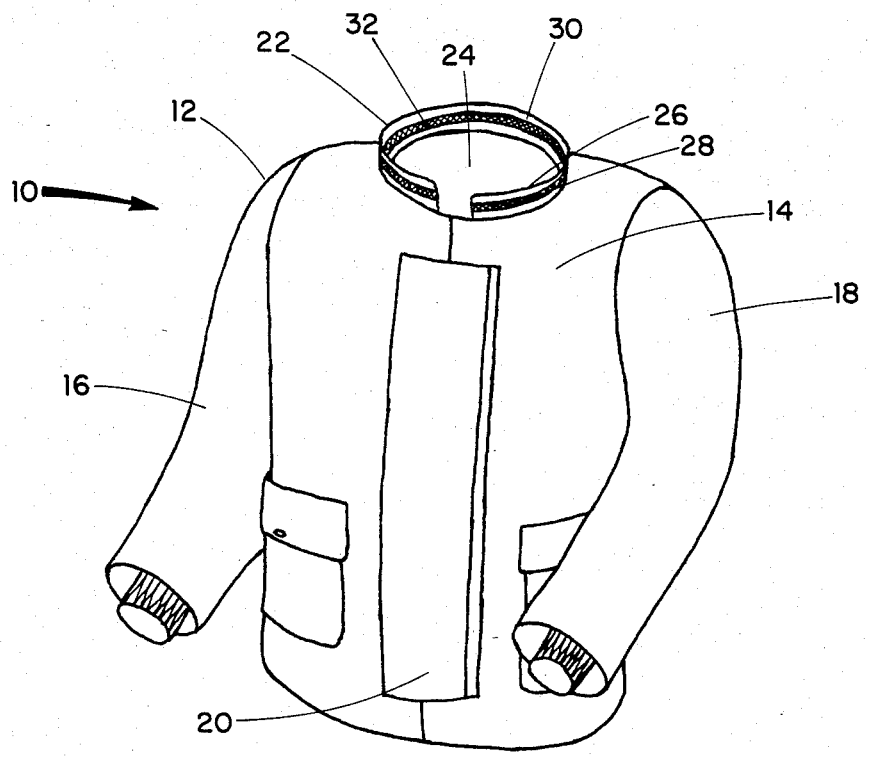
FIG. 1 is a perspective view of the outer shell of the protective garment.

Referring now to FIG. 1 there is shown a protective garment of the present invention, generally indicated as 10 and comprised of a damage resistant outer shell 12 having an openable body portion 14. The openable body 14 is formed with sleeves 16 and 18 appended and secured thereto and with a closure means 20, such as a zipper, not shown, for securing operable body portion 14. Openable body portion 14 is provided with a annular tab 22 extended circumferentially, substantially about an upper neck opening 24 and substantially perpendicular thereto. Annular tab 22 is preferably comprised of a bright flourescent material which contrasts with the remainder of the outer shell. The contrasting color permits the visual determination of the presence of the internal liner as will be more fully discussed hereafter. Annular tab 22 has circumferentially secured thereto on outer surface 26, a fastener means 28. The embodiments disclosed herein will reference the use of Velcro® fastening means. However, zippers, snap fasteners or other suitable fastening means may be used without the departing scope of the invention. Annular tab 22 also has circumferentially secured thereto on inner surface 30, a Velcro® fastener strip 32. Velcro® fastener strips 28 and 32 cooperate with an inner liner as more fully described hereinafter to secure the inner liner to the outer shell.

Figure 2:
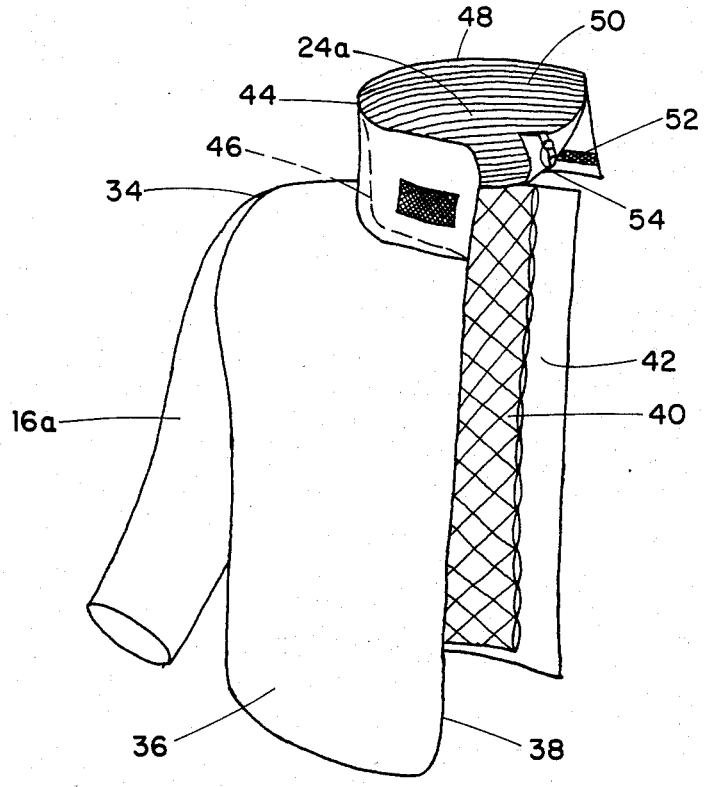
FIG. 2 is a perspective view, partially cut away of the outer shell with inner thermal liner.

Referring now to FIG. 2 there is shown a perspective cutaway view of inner liner 34. Inner liner 34 comprises an openable body portion 36 having appended thereto, sleeves 16*a* and 18*a* (not shown). Openable body portion 36 of inner liner 34 has a closure means 38 which is substantially coincidental with closure means 20 of outer shell 12. Openable body portion 36 when secured by closure means 38 defines a neck opening 24*a*. Inner liner 34 has an interior thermal layer 40 which is comprised of a material suitable to provide thermal insulation and an outer moisture barrier layer 42 which is comprised of a material suitable so as to provide a moisture barrier. Thermal layer 40 and moisture barrier layer 42 of inner liner 34 are secured together about openable body portion 36 and sleeve portions 16*a* and 18*a* of inner line 34.

Openable body portion 36 of inner liner 34 has secured to openable body portion 36, about neck opening 24*a*, a collar 44 extending circumferentially substantially about neck opening 24*a* and substantially perpendicular thereto. Collar 44 of inner liner 34 comprises an outer flap 46 which extends downwardly from upper edge 48 of collar 44 and is composed of outer shell material and secured about upper edge 48 of collar 44. Beneath outer flap 46 and secured about upper edge 48 of collar 44 is a moisture barrier layer 42 comprised of moisture barrier material. Layer 42 of moisture barrier material of collar 44 is secured not only about upper edge 48 of collar 44 but also to openable body portion 36 of inner liner 34. Secured to moisture barrier layer 42 of collar 44 is a suitable, soft, but durable cloth material 50. This layer is secured both at the upper edge 48 of collar 44 and at the lower edge of collar 44 where collar 44 is secured to openable body portion 36 of liner 34.

Secured to the underside of outer flap 46 is a Velcro® fastener 52 which extends circumferentially about outer flap 46. Secured to the outer side of moisture layer 42 of collar 44 is a Velcro® fastener 54 which extends circumferentially about moisture layer 42 on collar 44.

Outer shell 12 and liner 34 are secured by inserting sleeve 16*a* of liner 34 into sleeve 16 of outer shell 12 and inserting sleeve 18*a* of liner 34 into sleeve 18 of outer shell 12 thereby causing openable body portion 36 of liner 34 to coincide with openable body portion 14 of outer shell 12. Referencing FIG. 3, it can be seen that outer shell 12 is secured to liner 34 by raising flap 46 of collar 44 of liner 34 and positioning annular tab 22 of outer shell 12 such that inner Velcro® fastener 30 of annular tab 22 of outer shell 12 contacts Velcro® fastener 54 located on the moisture barrier layer 42 of collar 44 of liner 34. Flap 46 of collar 44 of liner 34 is then folded downwardly such that Velcro® fastener 52 located on the interior surface of flap 46 contacts Velcro® fastener 48 located on the outer surface 46 of collar 22 of outer shell 12.

In this configuration, the fire fighter now has an inner thermal layer 40 proximate to his body followed by a moisture barrier layer 42 which together comprise inner liner 34 and an outer shell 12 protecting the aforementioned layers. Flap 46 of collar 44 of inner liner 34 comprised of outer shell material thus provides the fire fighter with a layer of outer shell material extending downwardly from the upper edge 48 of collar 44 of the garment to its bottom. Additionally, the visual observance of collar 44 of liner 34 and in particular, outer flap 46, serves as an indication to supervisory personnel that the fire fighter is wearing a fully assembled garment designed to provide the maximum thermal protection. Additionally, due to the unique flap design, the fastening means is fully protected from liquids and debris by a continuous layer of moisture barrier and outer shell.

Figure 3:
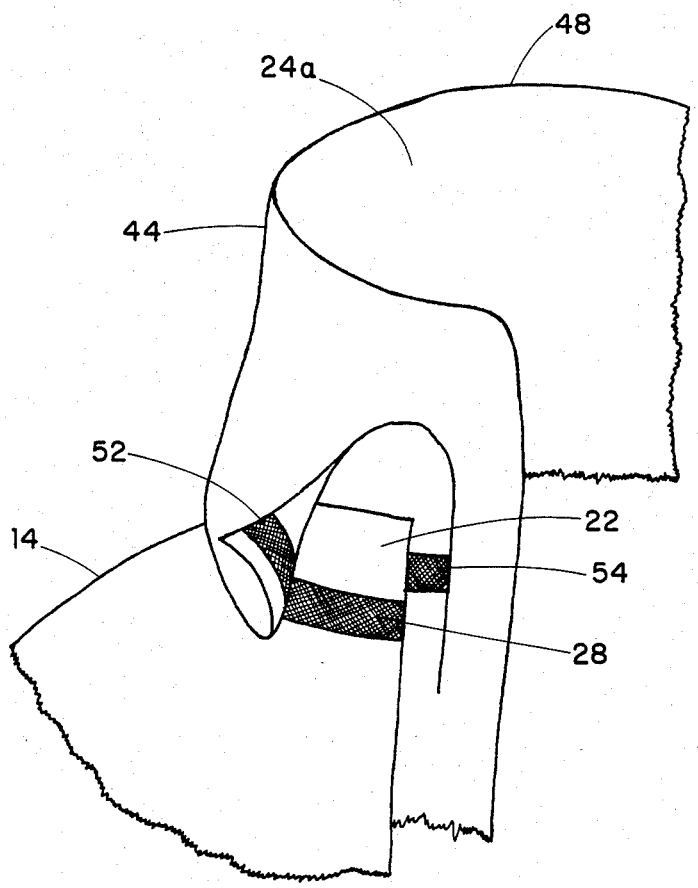
FIG. 3 is a perspective cut away blow up view of the outer shell secured to the inner thermal liner.
Figure 4:
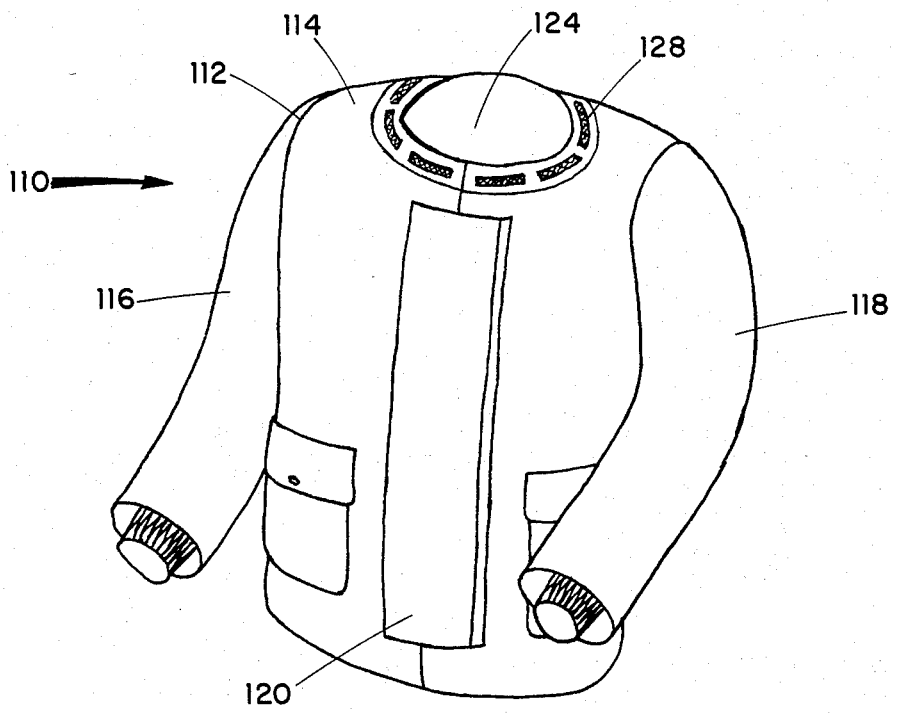
FIG. 4 is a perspective view of another embodiment of the present invention.

Referring now to FIG. 4 there is shown another emobidment of the present invention wherein FIG. 3 represents a perspective view of a protective garment generally indicated as 110 comprised of a damage resistant outer shell 112 having an openable body portion 114. Openable body portion 114 is formed with sleeves 116 and 118 appended and secured thereto and with a closure means 120, not shown, for securing openable body portion 114. Openable body portion 114 when secured by closure means 120 defines an upper neck opening 124. Openable body portion 114 has circumferentially disposed thereon about upper neck opening 124, a Velcro® fastener strip 128 which may be a continuous strip or an intermittent strip. The annular area immediately adjacent upper neck opening 124 is comprised of a bright fluorscent color contrasting with the remainder of outer shell 112 so as to permit the visual determination of the presence of an inner liner as will be more fully discussed hereafter. Velcro® strip 128 cooperates with an inner liner as more fully described hereafter to secure the inner liner to the outer shell.

Figure 5:
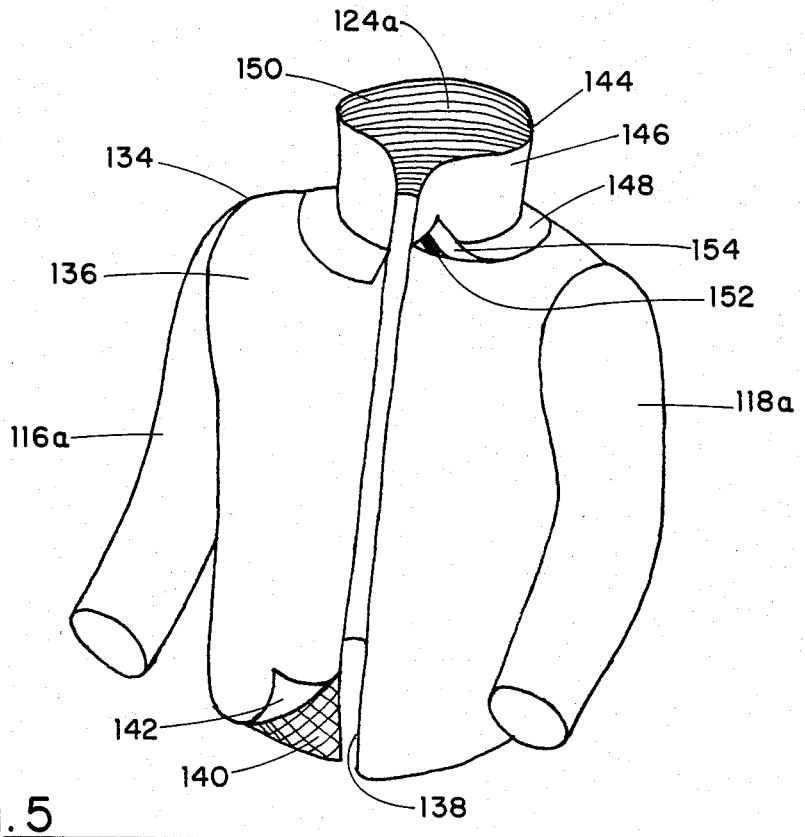
FIG. 5 is a perspective view of the embodiment of FIG. 3 with an inner thermal liner.

Referring now to FIG. 5 there is shown a perspective cutaway view of inner liner 134. Inner liner 134 comprises an openable body portion 136 having appended thereto, sleeves 116*a* and 118*a*. Openable body portion 136 of inner liner 134 has a closure means 138 which is substantially coincidental with closure means 120 of outer shell 112. Openable body portion 136 when secured by closure means 138 defines a neck opening 124*a*. Inner liner 134 has an interior thermal layer 140 which is comprised of a material suitable to provide thermal insulation and an outer moisture barrier 142 which is comprised of materials suitable so as to provide a moisture barrier. Thermal layer 140 and moisture barrier layer 142 of inner liner 134 are secured together about openable body portion 136 and sleeve portions 116*a* and 118*a* of inner liner 134.

Openable body portion 136 of inner liner 134 has secured to openable body portion 136, about neck opening 124*a*, a collar 144 extending circumferentially, substantially about neck opening 124*a* and substantially perpendicular thereto. Collar 144 of inner liner 134 comprises an outer surface 146 composed of outer shell material. Beneath outer surface 146 there is secured a moisture barrier layer 142 and the inner most surface of collar 144 so as to be in intimate contact with the neck of a fire fighter is a suitable, soft yet durable cloth or fabric material layer 150.

Secured about collar 144, proximate to collar 144's attachment to openable body portion 136 is an annular flap 148. Annular flap 148 extends circumferentially about collar 144 and is secured to collar 144 at annular flap 148's inner circumference. Positioned on the underside 154 of annular flap 148 is a Velcro ® fastener strip 152 which extends circumferentially about the underside 154 of annular flap 148.

Outer shell 122 and inner liner 134 are secured by inserting sleeves 116*a* of liner 134 into sleeve 116 of outer shell 112 and inserting sleeve 118*a* of liner 134 into sleeve 118 of outer 112 thereby causing openable body portion 136 of inner liner 134 to coincide with openable body portion 114 of outer shell 112. Outer shell 112 is secured to inner liner 134 by raising annular flap 148 circumferentially disposed about collar 144 of inner liner 134 and positioning outer shell 112 in such that the area proximate to neck opening 124 of outer shell 112 may be inserted beneath annular flap 148. In this configuration Velcro ® fastener strip 128 is positioned beneath annular flap 148 of collar 144 of inner liner 134. Annular flap 148 of inner liner 134 is then folded downwardly such that Velcro ® strip 152 on the underside surface 154 of annular flap 148 contacts annular Velcro ® strip 128 on openable body portion 114 of outer shell 112.

In this configuration, the fire fighter now has an inner thermal liner 140 proximate to his body followed by a moisture barrier layer 142 which together comprise the inner liner 134, an outer shell 112 of protecting the aforementioned layers. Collar 144 of inner liner 134 comprised of outer shell material and annular flap 148 also comprise of outer shell material thus provide the fire fighter with a layer of moisture barrier and outer shell material extending downwardly from the upper edge of collar 144 of the garment to its bottom. Additionally, the visual observance of collar 144 of inner liner 134 serves as an indication to supervisory personnel that the fire fighter is wearing a fully assembled garment designed to provide the maximum protection. Additionally, due to the unique flap design, the fastening means is fully protected from liquids and debris by a continuous layer of outer shell material.

Additionally, in both configurations when the firefighter reports to duty without his thermal liner in the garment, the absence of a normal collar configuration, and the flourescent color of the annular tab at the tope of the outer shell make it immediately obvious to his supervisor that the firefighter is not thermally protected, and thereby not equipped to handle the thermal exosure potential of fire suppression.

As stated previously, the embodiments disclosed herein have been described with fastening means identified as Velcro ® fasteners. It will be recognized by one skilled in the art that the use of zipper, snap fasteners or other suitable fastening means may be utilized without departing from the spirit or scope of the invention.

Further the embodiments herein have been described with the moisture barrier positioned between the outer shell and the thermal liner. In practice, the moisture barrier may be attached to the thermal liner as described herein, attached to the outer shell as a separate layer of cloth or the outer shell itself may be waterproofed to provide the moisture barrier or finally the moisture barrier may be a combination of the above. It will be recognized by one skilled in the art that the positioning of the moisture barrier may be varied without departing from the point or scope of the invention.

While the invention has been described in connection with the exemplary embodiments thereof, it will be understood that many modifications will be apparent to those of ordinary skill in the art and that this application is intended to cover any adaptations or variations thereof. Therefore, it is manifestly intended that this invention be only limited by the claims and the equivalent thereof.

I claim:

1. A multilayered protective overcoat for firefighters comprising:

a outer protective shell having an openable body portion, said openable body portion defining a neck opening;

an inner lining constructed of a thermal insulation layer; said inner lining having an openable body portion;

a moisture barrier layer;

a first collar secured to said inner lining, said first collar having a moisture impervious layer and a circumferential flap, said first collar defining a neck opening coincident with said neck opening of said outer protective shell, said collar extending through and beyond said neck opening of said outer protective shell to form a readily observable exterior collar of the assemblage of said outer protective shell and said inner lining; and a fastening means for removably securing said inner lining to said outer protective shell proximate to said first collar of said inner lining, said fastening means being disposed beneath said circumferential flap and protected by said circumferential flap.

2. A multilayered protective overcoat for firefighters in accordance with claim 1 wherein said outer protective shell has secured thereto an upwardly extending annular tab, said annular tab being displaced circumferentially about said neck opening, said annular tab having disposed circumferentially thereon internally and externally, a fastening means for cooperation with said fastening means of said first collar of said inner lining.

3. A multilayered protective overcoat for firefighters in accordance with claim 2 wherein said annular tab of said outer protective shell is inserted beneath said circumferential flap of said first collar of said inner lining, said circumferential flap of said inner lining having secured to the underside thereto, a fastening means for cooperation with said external fastening means of said annular tab of said outer protective shell for securing said inner lining to said outer shell and said first collar having secured on the outerside thereof, a fastening means for cooperation with said internal fastening means of said annular tab of said outer protective shell for securing said inner lining to said outer shell.

4. A multilayered protective overcoat for firefighters in accordance with claim 1 wherein said outer protective shell has secured on said openable body portion, about said neck opening, a fastening means for cooperation with said fastening means of said first collar of said inner lining.

5. A multilayered protective overcoat for firefighters in accordance with claim 4 wherein said fastening means of outer protective shell is inserted beneath said exterior circumferential flap of said first collar of said inner liner, for cooperation with said fastening means of said exterior circumferential flap for securing said innter lining to said outer protective shell.

6. A multilayered protective overcoat for firefighters in accordance with claim 1 wherein said fastening means for removably securing said inner lining to said outer protective shell comprises adhesive like fiber strips.

7. A multilayered protective overcoat for firefighters in accordance with claim 1 wherein said fastening means for removably securing said inner lining to said outer protective shell comprises a zipper arrangement.

8. A multilayered protective overcoat for firefighters in accordance with claim 1 wherein said fastening means for removably securing said inner lining to said outer protective shell comprises a snap fastener arrangement.

9. A multilayered protective overcoat for firefighters in accordance with claim 2 wherein said upwardly extending annular tab is of a bright fluorscent color contrasting with said outer protective shell.

10. A multilayered protective overcoat for firefighters in accordance with claim 4 wherein said fastening means about said neck opening of said outer protective shell is of a bright fluorscent color contrasting with said outer protective shell.

* * * * *